US006054245A

United States Patent [19]

Azuma et al.

[11] Patent Number: 6,054,245

[45] Date of Patent: Apr. 25, 2000

[54] ELECTROPHOTOGRAPHIC DEVELOPER AND PRODUCING METHOD THEREOF

[75] Inventors: Hidetoshi Azuma; Hiroshi Yamamoto, both of Tokuyama, Japan

[73] Assignee: Nippon Zeon Co., Ltd., Tokyo, Japan

[21] Appl. No.: 09/404,838

[22] Filed: Sep. 24, 1999

Related U.S. Application Data

[62] Division of application No. 09/102,663, Jun. 23, 1998.

[30] Foreign Application Priority Data

Jun. 24, 1997 [JP] Japan ..... 9-182963

[51] Int. Cl.[7] ..... G03G 9/08

[52] U.S. Cl. ..... 430/137

[58] Field of Search ..... 430/137

[56] References Cited

U.S. PATENT DOCUMENTS

| | | | |
|---|---|---|---|
| 3,544,458 | 12/1970 | Sato | 430/137 |
| 4,430,409 | 2/1984 | Matsumoto et al. | 430/106.6 |
| 4,661,439 | 4/1987 | Ruskin | 430/137 |
| 4,954,412 | 9/1990 | Breton et al. | 430/137 |
| 5,104,764 | 4/1992 | Wada et al. | 430/109 |
| 5,266,432 | 11/1993 | Hayashi et al. | 430/109 |
| 5,482,812 | 1/1996 | Hopper et al. | 430/137 |
| 5,525,452 | 6/1996 | Hopper et al. | 430/137 |
| 5,660,965 | 8/1997 | Mychajlowskij et al. | 430/137 |
| 5,962,179 | 10/1999 | Agur et al. | 430/137 |

FOREIGN PATENT DOCUMENTS

| | | |
|---|---|---|
| 06 330726 | 6/1996 | Japan . |
| 7-047168 | 9/1996 | Japan . |

*Primary Examiner*—Roland Martin

*Attorney, Agent, or Firm*—Armstrong, Westerman, Hattori, McLeland and Naughton

[57] ABSTRACT

An object of the present invention is to provide an electrophotographic developer having a good fluidity, an excellent shelf stability, and a lesser reduction in image quality under various conditions.

An electrophotographic one component nonmagnetic developer includes toner particles obtained by polymerizing a polymerizable monomer component, such as styrene, methacrylate, acrylate and the like, and outer-additives, such as silicon dioxide particles, on the toner particles. The developer has pH of 4 to 7 measured by a decoction method, and $\sigma 2$ of not more than 20 $\mu$S/cm and $\sigma 2-\sigma 1$ of 0 to 10 $\mu$S/cm, in which $\sigma 1$ is an electric conductivity of water, $\sigma 2$ is an electric conductivity measured by a decoction method.

17 Claims, 1 Drawing Sheet

ELECTROPHOTOGRAPHIC DEVELOPER AND PRODUCING METHOD THEREOF

This application is a division of prior application Ser. No. 09/102,663, filed Jun. 23, 1998, allowed.

FIELD OF THE INVENTION

This invention relates to an electrophotographic developer and a producing method thereof, and more particularly to an electrophotographic one component nonmagnetic developer having a good fluidity, a good shelf stability and a lesser reduction in image quality under various conditions, and a producing method thereof.

DESCRIPTION OF THE RELATED ART

An electrostatic latent image formed with a visible image forming apparatus, such as an electrophotographic printer, an electrophotographic duplicator or an electrostatic recorder, has been developed with a electrophotographic developer to obtain a visible image on photosensitive material, the visible image has been transcribed onto a transcription sheet such as a paper or a resin sheet for an Overhead Projector(OHP), and fixed on the sheet by heating, pressing, treating with a solvent vapor or so on.

A pulverized electrophotographic developer, which is obtained by adding colorant and other material into melted resin, solidifying the resin, pulverizing to granulate the resin, and classifying the resin particle was mainly used in the visible image forming apparatus. Recently, savings in electric power cost, higher speed duplicating or higher speed printing, and higher resolution visible image are demanded in an electrophotographic apparatus. So, attention has been directed to a polymerized electrophotographic developer obtained by polymerization of monomer composition containing colorant.

As the polymerized electrophotographic developer, a developer having a relationship between D2 and σ1 as the following formula is proposed:

$$5\ \mu S/cm \leqq D2-\sigma1 \leqq 50\ \mu S/cm$$

in which σ1 is an electric conductivity of water, D2 is an electric conductivity of a filtrate obtained by dispersing 1 g developer in 20 ml water having an electric conductivity of σ1 and filtrating the developer dispersion (see an unexaminated Japanese patent publication TOKUKAIHEI 8-248676). This proposed developer should be used as a two component magnetic developer which is charged by rubbing with a magnetic iron powder. If this proposed developer is used as a one component nonmagnetic developer which is charged by rubbing with a developing roll or a developing blade, image quality is reduced under various conditions since the charge amount is affected by conditions. Also a fluidity and shelf stability is reduced.

As the one component non-magnetic developer, the applicant proposed a polymerized developer having a metal ion content from water-insoluble metal compound of not more than 1000 ppm(see unexamined Japanese patent publication TOKUKAIHEI 8-160661). We should say a lesser reduction in image quality under various conditions is enhanced by this developer. However, further improvement of fluidity and shelf stability is demanded.

SUMMARY OF THE INVENTION

An object of the present invention is to provide an electrophotographic developer having a good fluidity, an excellent shelf stability, and a lesser reduction in image quality under various conditions.

Another object of the present invention is to provide a producing method of said electrophotographic developer.

And another object of the present invention is to provide an image forming method using said electrophotographic developer.

The present inventors made a study in order to achieve the above objects and found that the objects can be accomplished by providing an electrophotographic developer having the specific pH or an electrophotographic one component nonmagnetic developer having the specific electric conductivity.

In one aspect of the present invention, there is provided an electrophotographic developer comprising toner particles obtained by polymerizing a polymerizable monomer component and outer-additives on the toner particles, and having pH of 4 to 7 measured by a decoction method.

In another aspect of the present invention, there is provided an electrophotographic one component nonmagnetic developer comprising toner particles obtained by polymerizing a polymerizable monomer component and outer-additives on the toner particles, and having σ2 of not more than 20 μS/cm and σ2−σ1 of not more than 10 μS/cm, in which σ1 is an electric conductivity of water, and σ2 is an electric conductivity measured by a decoction method.

In another preferred embodiment of the electrophotographic one component nonmagnetic developer, the developer further has pH of 4 to 7 measured by a decoction method.

In another preferred embodiment of the electrophotographic one component nonmagnetic developer, the developer further has D2−σ1 of less than 5 μS/cm, in which σ1 is an electric conductivity of water, D2 is an electric conductivity of filtrate obtained by dispersing 1 g developer in 20 ml water having an electric conductivity of σ1 and filtrating the developer dispersion.

In another preferred embodiment of the electrophotographic one component nonmagnetic developer, the polymerizable monomer component comprises styrene derivative monomer, acrylate or methacrylate monomer and crosslinkable monomer.

In another preferred embodiment of the electrophotographic one component nonmagnetic developer, the polymerizable monomer component further comprises macro monomer.

In another preferred embodiment of the electrophotographic one component nonmagnetic developer, the outer-additive is a silicon dioxide particle.

In another preferred embodiment of the electrophotographic one component nonmagnetic developer, the outer-additive consists of a small size particle, preferably a small size inorganic oxide particle, having number average particle size of 5 nm to 20 nm, preferably 7 nm to 18 nm and a large size particle, preferably a large size inorganic oxide particle, having number average particle size of more than 20 nm and not more than 2 μm, preferably 30 nm to 1 μm.

In another preferred embodiment of the electrophotographic one component nonmagnetic developer, the toner particles contain a colorant, an electric charge controlling agent and a surface lubricant.

In another preferred embodiment of the electrophotographic one component nonmagnetic developer, a fixing temperature thereof is 80 to 140° C.

In another preferred embodiment of the electrophotographic one component nonmagnetic developer, a volume average particle size of the toner particles is 1 to 20 μm.

In another preferred embodiment of the electrophotographic one component nonmagnetic developer, a proportion(dv/dp) of volume average toner particle size(dv) and number average toner particle size(dp) is not more than 1.7.

In another preferred embodiment of the electrophotographic one component nonmagnetic developer, a proportion(rl/rs) of major axis(rl) and minor axis(rs) is 1 to 1.2.

In another aspect of the present invention, there is provided a method of producing the electrophotographic developer comprising the steps of: polymerizing a polymerizable monomer component to obtain an electrophotographic toner particles dispersion, filtering the electrophotographic toner particles dispersion through a filter cake layer containing polymer particles in order to clean the electrophotographic toner particles, drying the electrophotographic toner particles, and adhering outer-additives on the electrophotographic toner particles.

Another preferred embodiment of the method of producing the electrophotographic developer further comprises a step of regulating pH, before the filtering step, so that the electrophotographic toner particles dispersion has pH of not more than 6.5.

In another preferred embodiment of the method of producing the electrophotographic developer, the electrophotographic toner particles dispersion obtained by the polymerizing step has pH of 8 to 12.

In another preferred embodiment of the method of producing the electrophotographic developer, the electrophotographic toner particles have an average particle size of 1 to 20 $\mu$m, preferably 1.5 to 15 $\mu$m.

In another preferred embodiment of the method of producing the electrophotographic developer, the polymer particles in the filter cake layer are larger than the electrophotographic toner particles by 10 $\mu$m or less, preferably 5 $\mu$m or less, and are smaller than the electrophotographic toner particles by about 1 $\mu$m or less, preferably about 0.5 $\mu$m or less.

In another preferred embodiment of the method of producing the electrophotographic developer, the polymer particles in the filter cake layer are formed of copolymer comprising styrene, methacrylate or acrylate.

In another preferred embodiment of the method of producing the electrophotographic developer, the polymer particles in the filter cake layer contain colorant, electric charge controlling agent and surface lubricant.

In another preferred embodiment of the method of producing the electrophotographic developer, the polymer particles in the filter cake layer have melt index of not more than 60 at temperature of 150° C. and load of 10 kgf.

In another aspect of the present invention, there is provided an image forming method comprising the steps of: recording an electrostatic latent image on a photosensitive material, attaching the above developer on the photosensitive material to obtain a visible image, and transcribing the visible image onto a transcription sheet.

DETAILED DESCRIPTION OF THE PREFERRED EMBODIMENTS

Figure 1:
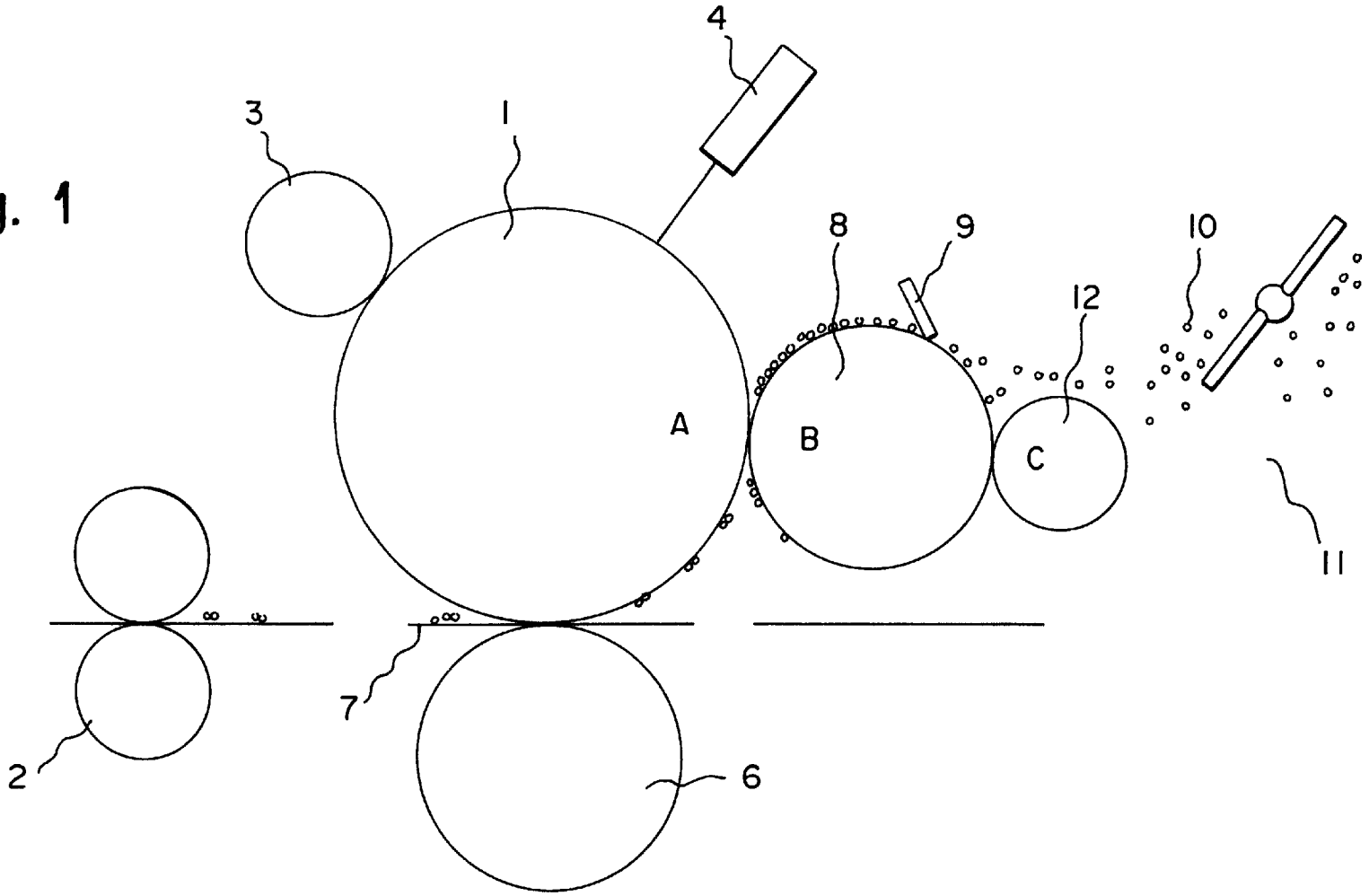
FIG. 1 illustrates an embodiment of an image forming apparatus.

An electrophotographic developer of this invention comprises toner particles and outer-additives on the toner particles.

The toner particles are obtained by polymerizing a polymerizable monomer component.

The polymerizable monomer component comprises at least one mono-vinyl monomer and preferably at least one crosslinkable monomer.

As the mono-vinyl monomer used in the present invention, examples are styrene derivative monomers such as styrene, vinyltoluene and $\alpha$-methyl styrene; derivatives of acrylic acid or methacrylic acid such as acrylic acid, methacrylic acid, methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated mono-olefin such as ethylene, propylene and butylene; halogenated vinyl monomer such as vinyl chloride, vinylidene chloride and vinyl fluoride; vinyl ester such as vinyl acetate and vinyl propionate; vinyl ether such as vinylmethyl ether and vinylethyl ether; vinyl ketone such as vinyl methyl ketone and methyl isopropenyl ketone; vinyl compounds containing nitrogen such as 2-vinyl pyridine, 4-vinyl pyridine and N-vinyl pyrrolidone; and so forth. These mono-vinyl monomers can be used either alone or in combination. Of these mono-vinyl monomers, styrene derivative monomers, or derivatives of acrylic acid or methacrylic acid can be preferably used.

A crosslinkable monomer is preferably used with the mono-vinyl monomer to enhance shelf stability. As the crosslinkable monomer, examples are aromatic divinyl compounds such as divinylbenzene, divinylnaphthalene, and derivatives thereof; di-ethylenically unsaturated carboxylates such as ethylene glycol di-methacrylate and di-ethylene glycol di-methacrylate; di-vinyl compounds such as N,N-divinyl aniline and di-vinyl ether; compounds having at least three vinyl groups and so on. These crosslinkable monomers can be used either alone or in combination. The amount of the crosslinkable monomer is usually in a range of 0.05 to 5 parts by weight, preferably 0.1 to 2 parts by weight, based on 100 parts by weight of the mono-vinyl monomer.

A macro-monomer used furthermore with the mono-vinyl monomer is preferable, since the balance of shelf stability and fixability is enhanced thereby. The macro-monomer is an oligomer or a polymer having polymerizable vinyl groups on the ends of the molecular chain and having a number average molecular weight of generally 1,000 to 30,000. If the number average molecular weight is too small, the surface of the toner particle tends to become limp, and shelf stability tends to be reduced. If the number average molecular weight is too large, solubility of the macro-monomer tends to be reduced, and fixability and shelf stability tend to be reduced. As the polymerizable vinyl group on the ends of the molecular chain of the macro-monomer, there can be mentioned acrylyl group, methacrylyl group and so on. Methacrylyl group is preferable in view of co-polymerizability.

As the macro-monomer, examples are a polymer obtained by polymerizing a monomer, such as styrene, derivative of styrene, methacrylate, acrylate, acrylonitrile, methacrylonitrile and so forth, either alone or in combination; a macromonomer having a polysiloxane unit; and a macromonomer as disclosed in pages 4 to 7 of Japanese laid open patent application Tokukaihei 3-203746.

In these macro-monomers, a hydrophilic macromonomer, especially a polymer obtained by polymerizing methacrylate or acrylate either alone or in combination is preferable for the present invention.

The amount of the macro-monomer is generally 0.01 to 10 parts by weight, preferably 0.03 to 5 parts by weight, more preferably 0.05 to 1 part by weight, based on 100 parts by weight of the mono-vinyl monomer. If the amount of the macro-monomer is too small, shelf stability is not satisfied. If the amount of the macro-monomer is too large, fixability tends to be reduced.

The toner particles generally contain a colorant, and as occasion demands contains an electric charge controlling agent, a surface lubricant and a dispersant for the colorant.

As the colorant used in this invention, examples are a dye or pigment such as carbon black, titan white, nigrosine base, aniline blue, chaico oil blue, chrome yellow, ultra marine blue, orient oil red, phthalocyanine blue, malachite green; magnetic particles such as cobalt, nickel, iron sesquioxide, triiron tetraoxide, manganese iron oxide, zinc iron oxide, nickel iron oxide.

A colorant for a magnetic color toner as a dye, examples are C.l. Direct red 1, C.l. Direct red 4, C.l. Acid red 1, C.l. Basic red 1, C.l. Mordant red 30, C.l. Direct blue 1, C.l. Direct blue 2, C.l. Acid blue 9, C.l. Acid blue 15, C.l. Basic blue 3, C.l. Basic blue 5, C.l. Mordant blue 7, C.l. Direct green 6, C.l. Basic green 4, C.l. Basic green 6 and the like. As a pigment, there can be mentioned chrome yellow, cadmium yellow, mineral first yellow, navel yellow, naphtol yellow S, hanseatic yellow G, permanent yellow NCG, turtlazin lake, chrome orange, molybdate orange, permanent orange GTR, pyrazoline orange, benzidine orange G, cadmium red, permanent red 4R, watching red calcium salt, eosin lake, brilliant carmine 3B, manganate violet, first violet B, methyl violet lake, prussian blue, cobalt blue, alkali blue lake, victoria blue lake, phthalocyanine blue, first sky blue, indanthrene blue BC, chrome green, chrome oxide, pigment green B, malachite green lake, final yellow green G.

As a magenta color pigment for a full color toner, examples are C.l. Pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.l. Pigment violet 19; C.l. Vat red 1, 2, 10, 13, 15, 23, 29, and 35. As a magenta dye, examples are an oil-soluble dye such as C.l. Solvent red 1, 3, 8, 23, 24, 25, 27, 30, 49, 81, 82, 83, 84, 100, 109, and 121; C.l. Disperse red 9; C.l. Solvent violet 8, 13, 14, 21, and 27; C.l. Disperse violet 1; a basic dye such as C.l. Basic red 1, 2, 9, 12, 13, 14, 15, 17, 18, 22, 23, 24, 27, 29, 32, 34, 35, 36, 37, 38, 39, and 40; C.l. Basic violet 1, 3, 7, 10, 14, 15, 21, 25, 26, 27 and 28.

As a cyan color pigment for a full color toner, examples are C.l. Pigment blue 2, 3, 15, 16, and 17; vat blue 6; C.l. Acid blue 45; a copper phthalocyanine dye substituted with 1 to 5 of phthalimide methyl groups into the phthalocyanine structure and the like.

As a yellow color pigment for a full color toner, examples are C.l. Pigment yellow 1, 2, 3, 4, 5, 6, 7, 10, 11, 12, 13, 14, 15, 16, 17, 23, 65, 73, 83, and 138; C.l. Vat yellow 1, 3, and 20.

The amount of the pigment or dye, based on 100 parts by weight of the mono-vinyl monomer, is generally 0.1 to 20 parts by weight, preferably 1 to 10 parts by weight. The amount of a magnetic particle, based on 100 parts by weight of the mono-vinyl monomer, is generally 1 to 100 parts by weight, preferably 5 to 50 parts by weight.

As the surface lubricant, examples are a low molecular weight polyolefin such as a low molecular weight polyethylene, a low molecular weight polypropylene, a low molecular weight polybutylene and paraffin wax.

The amount of the surface lubricant, based on 100 parts by weight of the mono-vinyl monomer, is generally 0.1 to 20 parts by weight, preferably 1 to 10 parts by weight.

The electric charge control agent is used to enhance the chargeability of the toner. The electric charge control agent may have either a negative or a positive electric charge. As the electric charge control agent, examples are an organometallic complex having a nitrogen-containing group or carboxyl group, dyes containing metal, nigrosine and the like, more especially 'Bontoron N01' (Nigrosine produced by Orient Chemical Co.), 'Nigrosine EX' (produced by Orient Chemical Co.), 'Aizen Spilon black TRH' (produced by Hodogaya Chemical Co.), 'T-77' (produced by Hodogaya Chemical Co.), 'Bontron S-34' (produced by Orient Chemical Co.), 'Bontron E-84' (produced by Orient Chemical Co.), 'Copyblue PR' (produced by Hoechst Co.). The amount of the electric charge control agent, based on 100 parts by weight of the mono-vinyl monomer, is generally 0.01 to 10 parts by weight, preferably 0.03 to 5 parts by weight.

Furthermore, for purpose of uniform dispersion of the colorant in the toner particle, a lubricant such as oleic acid and stearic acid; a dispersion assistant such as a silane coupling agent and titanium coupling agent; and the like can be used. These lubricants or dispersion assistants, based on the weight of the colorant, are generally used in 1/1000 to 1/1 weight proportion.

As the polymerization method of the polymerizable monomer component, examples are suspension polymerization method, emulsion polymerization method, dispersion polymerization method and so on. In this invention, the toner particle obtained by suspension polymerization is preferable.

As the outer-additives on the surface of the toner particles, examples are inorganic particles and organic resin particles. As the inorganic particles, examples are silicon dioxide, aluminium oxide, titanium oxide, zinc oxide, stannic oxide, stannous oxide, barium titanale, strontium titanate, and the like. As the organic resin particles, examples are polymer particles of a methacrylate, polymer particles of an acrylate, copolymer particles of styrene and methacrylate, copolymer particles of styrene and acrylate, core-shell type polymer particles having a core formed of methacrylate polymer and a shell formed of styrene polymer and the like. In these outer-additives, inorganic particles, especially silicon dioxide particles are preferable. These particles may be reformed by hydrophobic treatment. The hydrophobic reformed particles, especially the hydrophobic reformed silicon dioxide particles, are preferable. The amount of the outer-additives is, based on 100 parts by weight of the toner particles, generally 0.1 to 6 parts by weight.

The outer-additives can be used either alone or in combination. Where the outer-additives are used in combination, it is preferable to use a small size particle, preferably a small size inorganic oxide particle and a large size particle, preferably a large size inorganic oxide particle.

As the combination of a large size particle and a small size particle, it is preferable that a combination of a small size inorganic oxide particle having number average particle size of 5 nm to 20 nm, preferably 7 nm to 18 nm, and a large size inorganic oxide particle having number average particle size of more than 20 nm and not more than 2 $\mu$m, preferably 30 nm to 1 $\mu$m is used. The average particle size of particles for the outer-additives are obtained by measuring 100 particles observed by a transmission electron microscope.

The amount of the small size particle as the outer-additives is, based on 100 parts by weight of the toner particles, generally 0.1 to 3 parts by weight, preferably 0.2 to 2 parts by weight. The amount of the large size particles as the outer-additives is, based on 100 parts by weight of the toner particles, generally 0.1 to 3 parts by weight, preferably 0.2 to 2 parts by weight. A proportion of the amount of the small size particles and the amount of the large size particles is generally 1/5 to 5/1, preferably 3/10 to 10/3.

In order to bind the outer-additive on the toner particle, generally, the outer-additive and the above toner particles are charged in a mixer such as Henschel mixer and are stirred.

The electrophotographic developer has pH of 4 to 7, preferably 4.5 to 6.5 measured by a decoction method. If pH is less than 4 or pH is more than 7, the electron charge variability of the developer is enlarged due to ambient conditions so that the image quality is often reduced.

The pH measured by a decoction method is obtained by dispersing 6 grams of the developer in 100 grams of ion exchanged water, boiling the dispersion for ten minutes, adding an ion exchanged water boiled for ten minutes to refill to the former volume, and then observing the pH of the dispersion with a pH meter at room temperature.

Also, the electrophotographic one component nonmagnetic developer has $\sigma 2$ of not more than 20 $\mu$S/cm, preferably not more than 15 $\mu$S/cm, and $\sigma 2-\sigma 1$ of 0 to 10 $\mu$S/cm, preferably 0 to 5 $\mu$S/cm, in which $\sigma 1$ is an electric conductivity of water, $\sigma 2$ is an electric conductivity measured by a decoction method. The electric conductivity of water, $\sigma 1$, is generally 0 to 15 $\mu$S/cm. If $\sigma 2$ is too large or $\sigma 2-\sigma 1$ is too large, the electron charge variability of the developer is enlarged due to ambient conditions so that the image quality is often reduced.

The $\sigma 2$ is an electric conductivity measured by a decoction method. The $\sigma 2$ is obtained by dispersing 6 grams of the developer in 100 grams of ion exchanged water having $\sigma 1$, boiling the dispersion for ten minutes, adding an ion exchanged water having $\sigma 1$ boiled for ten minutes to refill to the former volume, and then observing the electric conductivity, $\sigma 2$, of the dispersion with an electric conductivity meter at room temperature.

The electrophotographic one component nonmagnetic developer further has $D2-\sigma 1$ of less than 5 $\mu$S/cm, preferably not more than 4 $\mu$S/cm, in which $\sigma 1$ is an electric conductivity of water, D2 is an electric conductivity of filtrate obtained by dispersing 1 g developer in 20 ml of the water having an electric conductivity of $\sigma 1$ and filtrating the developer dispersion. If $D2-\sigma 1$ is too large, the electron charge variability of the developer is enlarged due to ambient conditions so that the image quality tends to be reduced.

In the electrophotographic one component nonmagnetic developer of this invention, the volume average particle size is generally 1 to 20 $\mu$m, preferably 1.5 to 15 $\mu$m, more preferably 1.5 to 8 $\mu$m. Also, the ratio of the volume average particle size (hereafter "dv") and the number average particle size (hereafter "dp), that is dv/dp, is generally not more than 1.7, preferably not more than 1.5.

The electrophotographic one component nonmagnetic developer of this invention has a ratio of major axis (hereafter "rl") and minor axis (hereafter "rs"), that is rl/rs, being generally 1 to 1.2, preferably 1 to 1.1. If this ratio is too large, resolution of image and durability tend to be reduced, since toner particles undergo larger friction with each other and the outer-additive falls off while the toner is in the toner housing of a visible image forming apparatus.

A method of producing the electrophotographic developer of this invention comprises a step of polymerizing the polymerizable monomer component to obtain an electrophotographic toner particles dispersion, a step of filtering the electrophotographic toner particles dispersion through a filter cake layer containing polymer particles in order to clean the electrophotographic toner particles, a step of drying the electrophotographic toner particles, and a step of adhering the outer-additives on the electrophotographic toner particles.

The electrophotographic toner particles have the volume average particle size of generally 1 to 20 $\mu$m, preferably 1.5 to 15 $\mu$m, more preferably 1.5 to 8 $\mu$m.

A volume average particle size of the polymer particles in the filter cake layer used in the filtering step is larger than that of the electrophotographic toner particles by 10 $\mu$m or less, preferably 5 $\mu$m or less, more preferably 1 $\mu$m or less, and is smaller than that of the electrophotographic toner particles by about 1 $\mu$m or less, preferably about 0.51 $\mu$m or less, because the filter cake layer is available for the filtration for many hours. If the average particle size of the polymer particles is too small, the filter cake layer is closely packed and the channels in the filter cake layer are narrowed such that a dehydration ability of the filter is reduced, a water content of the filtered electrophotographic toner particles is enlarged, so as the charge amount and so on of the developer tend to be affected by the conditions.

The polymer particles in the filter cake layer have a melt index of not more than 60 at temperature of 150° C. and load of 10 kgf. If the melt index is too large, the filter cake layer is closely packed and the channels in the filter cake layer are narrowed.

The polymer particles are not limited by a polymer forming the polymer particles. In order to reduce a contamination in the developer to the minimum, it is preferable that the polymer particles are formed of a similar polymer to the electrophotographic toner particles, and contain a colorant, an electric charge controlling agent and a surface lubricant. Specific examples of the polymer forming the polymer particles are a copolymer of styrene monomer or derivative thereof and acrylic acid, a copolymer of styrene monomer or derivative thereof and methacrylic acid, and a copolymer of styrene monomer or derivative thereof and derivative of methacrylic acid or acrylic acid; preferably a copolymer of styrene and acrylate and a copolymer of styrene and methacrylate. In the method of this invention, a thickness of the filter cake layer is generally 2 to 20 mm, preferably 5 to 15 mm.

As the filtration method, there is mentioned a centrifugal filtration method, a vacuum filtration method, a pressure filtration method and the like. Among these filtration methods, the centrifugal filtration method is preferable.

Specific examples of a centrifugal filtration equipment are a peeler centrifuge, a siphon peeler centrifuge and so on. In the centrifugal filtration method, a centrifugal acceleration is generally 400 to 3000 G, preferably 800 to 2000 G. The percentage of moisture content after the filtration is generally 5 to 30 weight %, preferably 8 to 25 weight %. If the moisture content is too large, it takes a lot of time for the step of drying. Also, the properties of the developer tend to be affected by the conditions, since impurities are concentrated by drying even though a concentration of impurities in water is low. The percentage of moisture content is calculated by the following formula:

$$\text{the percentage of moisture content}=((W_0-W_1)/W_0)\times 100[\%]$$

in which $W_0$ is weight of the toner particles after the step of drying, $W_1$ is weight of the toner particles obtained by leaving $W_0$ of the toner particles in a dryer set to 105° C. for 1 hour and then cooling them.

A pH of a dispersion of the toner particles for the developer obtained by suspension polymerization is generally 8 to 12, preferably 8.5 to 11. If pH is too low, the toner particles for the developer fall into a wide distribution of particle size.

It is preferable that the pH of the dispersion of the toner particles for the developer is adjusted to not more than 6.5 before the step of filtration. In order to adjust pH, an inorganic acid such as sulfuric acid, hydrochloric acid, nitric acid and the like; or an organic acid such as carboxylic acid and the like is used. Sulfuric acid is especially preferable.

The method of producing the electrophotographic developer of this invention is preferable to obtain an electrophotographic developer having a fixing temperature of generally 80 to 140° C., preferably 80 to 130° C., that is the developer for the low temperature fixation. The developer for the low temperature fixation comprises toner particles having a low glass transition temperature, preferably core-shell type toner particles constituted of a core having low glass transition temperature and a shell having high glass transition temperature.

A method of image formation comprises a step of charging a surface of a photosensitive material; a step of recording an electrostatic latent image on the surface of the photosensitive material; a step of storing the above developer; a step of developing the electrostatic latent image on the surface of the photosensitive material with the developer to obtain a developer image; a step of transcribing the developer image from the surface of the photosensitive material onto a transcription sheet; and a step of fixing the developer image onto the transcription sheet.

The method of image formation is explained in detail based on an embodiment illustrated in the accompanying figure.

As illustrated in FIG. 1, an image formation apparatus used for the method of image formation comprises a photosensitive drum 1 as a photosensitive material, which is revolvable along the direction of the arrow A. The photosensitive drum comprises a photoelectric conductive layer provided on the surface of a drum material having electric conductivity. The photoelectric conductive layer is made of organic photosensitive material. selenium photosensitive material, zinc oxide photosensitive material, amorphous silicone photosensitive material, and the like.

Around the photosensitive drum 1, along the circumferential direction thereof, a charge roll 3 as means for charging, a laser irradiation equipment 4 as means for recording, a developing roll 8 as means for developing, a transcribing roll 6 as means for transcribing, and a cleaning equipment are fixed.

The charge roll 3 for charging the surface of the photosensitive drum positively or negatively is provided with voltage, and touches the surface of the photosensitive drum. Thus, the surface of the photosensitive drum can be uniformly charged. Charging means by corona discharge can be substituted for the charge roll.

The laser irradiation equipment 4 is one for irradiating rays of light corresponding to the image signal on the surface of the photosensitive drum which was uniformly charged and for forming a static image on the irradiated portion (in the case of reversal development) or non-irradiated portion (in the case of regular development). As the other recording means, there can be mentioned recording means comprised of an LED array and an optical instrument.

The developing roll 8 is one for adhering the developer on the static image of the photosensitive drum 1. Bias voltage between the developing roll and the photosensitive drum is applied for the developer to be adhered on the irradiated portion in the case of reversal development or on the non-irradiated portion in the case of regular development.

There is a supplying roll 12 next to the developing roll 8 in a casing 11 in which the developer 10 is stocked.

The developing roll is in contact with the photosensitive drum, and revolves along the direction of the arrow B. The supplying roll is in contact with the developing roll, revolves along the direction of the arrow C, and supplies the toner to the surface of the developing roll. To supply the toner smoothly, the supplying roll also is provided with voltage.

A developing blade 9, as means for regulating the thickness of the developer layer on the surface of the developing roll, is fixed on the surface of the developing roll between the contact point with the supplying roll and the contact point with the photosensitive drum. This developing blade is comprised of conductive rubber and stainless steel, and is provided with voltage of 12001 to 16001 Volt(absolute value) in order to impart an electric charge to the developer. Therefore it is preferable that resistivity of the blade is not more than $10^6$ Ohm centimeter (Ωcm).

The above developer 10 is stocked in the casing 11. Since the developer 10 of this invention has a good shelf stability and a good fluidity, it is rare that the toner aggregates in the casing 11 and that a poor quality image having blur, fog or the like is formed.

The transcribing roll 6 is one for transcribing the developer image from the surface of the photosensitive drum onto a transcription sheet 7. As the transcription sheet, examples are paper, OHP sheet and so on. As the transcribing means, examples are the above transcribing roll, corona discharger, transcribing belt and so forth.

The developer image transcribed onto the sheet is fixed on the sheet by fixing means 2. The fixing means is generally comprised of heating means and pressing means. The developer image transcribed onto the sheet is melted by heating means and the melted developer is pressed by pressing means to fix the developer on the sheet.

In the method of image formation of this invention, since the above developer is used, even if the heating temperature by heating means is low, the developer can be melted easily and be fixed flatly on the surface of the transcription sheet with only light pressure. Therefore the method of image formation of this invention is available for high speed printing or high speed duplication and has an excellent OHP transparency.

The cleaning equipment is for cleaning residual developer on the surface of the photosensitive drum after the transcribing step. For example, the cleaning equipment is comprised of a cleaning blade. This cleaning equipment is not always needed, if a system in which toner can be simultaneously developed and cleaned by a developing roll is adopted.

The invention will now be described specifically by the following examples that by no means limit the scope of the invention. In the examples parts or % are by weight unless otherwise specified.

The properties were determined by the following methods.

(1)Fluidity

A top sieve of 150 μm, a middle sieve of 75 μm and a bottom sieve of 45 μm were piled up in order, and 4 g of developer were put on the top sieve. The pile sieve was vibrated with a powder measuring instrument ('Powder Tester' trade name; produced by Hosokawa Micron Co.) under a vibration intensity of 4 for 15 seconds. A weight of the remaining developer on each sieve was measured, fluidity was evaluated by the following formula:

$$\text{Fluidity}(\%)=100-(A+B+C)$$

in which

A = (the weight of the remaining developer on the 150 μm sieve) / 4×100,

B = (the weight of the remaining developer on the 75 μm sieve) / 4×100×0.6,

C = (the weight of the remaining developer on the 45 μm sieve) / 4×100×0.2.

The above evaluation test was carried out three times a batch, and the mean thereof was calculated.

(2)Fixability

Printing all over (i.e., to cover the entire surface of a sheet) was carried out with a non-magnetic one-component developing system printer, which can print 4 sheets a minute, having a variable fixing roll temperature. The image density (ID0) of the sheet printed all over was measured with a reflecting image density measuring instrument (produced by MacBeth Co.). Adhesive tape (Scotch mending tape 810-3-18, produced by Sumitomo 3M Co.) was placed on the sheet printed all over, was pressed on the sheet at 500 g weights of a cylindrical stainless steer 2 cm in width, and was peeled off at a uniform rate in parallel to the sheet. After that, the image density (ID1) of the sheet was measured with the reflecting image density measuring instrument (produced by MacBeth Co.). Fixability was determined by the following formula:

$$\text{Fixability}(\%)=(ID1/ID0)\cdot 100$$

The correlation between the fixability and the fixing roll temperature was obtained. The fixing temperature was defined as a fixing roll temperature giving a fixability of 80%.

(3)Shelf Stability

The developer was placed into a box, the box was made airtight, and the box was sunk in a constant-temperature water bath of 55° C. for 8 hours. After that, the developer was taken out from the box and was placed on a 42-mesh sieve, keeping the aggregated developer structure from breaking. The sieve was vibrated with a powder measuring instrument ('Powder Tester' trade name; produced by Hosokawa Micron Co.) under a vibration intensity of 4.5 for 30 seconds. The weight of toner which did not pass through the sieve was measured. Aggregation (% by weight) of toner was determined from the weight of the toner which did not pass through and the total weight of toner used in this test. The above evaluation test was carried out three times a batch.

(4)The Amount of Electric Charge

The amount of electric charge was measured under L/L conditions (temperature of 10° C., and humidity of 20% RH) or H/H conditions (temperature of 35° C., and humidity of 80% RH).

The developer was set in the above non-magnetic one-component developing system printer(4-sheets/min) under each of the above conditions. After one day, five sheets having a halftone printing pattern were printed. Developer on the developing roll was aspirated with an aspiration electric charge amount measuring instrument, and the amount of electric charge based on the weight of toner was determined from a correlation of electric charge and aspiration.

(5)Quality of Printing Image

Continuous printing was carried out with the above printer under the H/H and L/L conditions. Quality of the printing image was evaluated by the following index.

A: not less than ten thousand sheets having printing density of not less than 1.3, as measured with a reflecting image density measuring instrument (produced by Macbeth Co.), and fog on non-picture portion of not more than 10%, as measured with a white colorimetry measuring instrument, can be obtained.

B: not less than five thousand to less than ten thousand sheets having printing density of not less than 1.3, as measured with a reflecting image density measuring instrument, and fog on non-picture portion of not more than 10%, as measured with a white colorimetry measuring instrument, can be obtained.

C: less than five thousand sheets having printing density of not less than 1.3, as measured with a reflecting image density measuring instrument, and fog on non-picture portion of not more than 10%, as measured with a white colorimetry measuring instrument, can be obtained.

EXAMPLE 1

A monomer composition for core consisting of 78 parts of styrene and 22 parts of n-butyl acrylate (giving a copolymer having a calculated glass transition temperature of 50° C.), 7 parts of carbon black ('Printex 150T' trade name; produced by Degussa AG), 1 part of charge control agent ('Aizen Spilon Black TRH' trade name, produced by HODOGAYA Chemical Co.), 0.3 part of divinylbenzene, 0.8 part of poly-methacrylate macro-monomer ('AA6' trade name, glass transition temperature of 94° C., produced by TOA GOUSEI Chemical Industries Co., Ltd.), and 10 parts of penta-erythritol-tetra-stearate were dispersed with a homo mixer(TK Type, produced by TOKUSHUKIKAKOU Co.) of 12,000 rpm to obtain a core monomer mixture.

Meanwhile, 10 parts of methyl methacrylate (giving a polymer having a calculated glass transition temperature of 105° C.), and 100 parts of water were dispersed finely with a supersonic emulsifier to give a shell monomer dispersion. The droplets of shell monomer had a 1.6 μm of D90 measured with a micro-trac particle size distribution measuring instrument at a droplet concentration of 3% in an aqueous solution of 1% sodium hexa-meta-phosphate.

On the other hand, into an aqueous solution obtained by dissolving 9.8 parts of magnesium chloride in 250 parts of ion exchanged water, an aqueous solution obtained by dissolving 6.9 parts of sodium hydroxide in 50 parts of ion exchanged water was slowly added to obtain a dispersion of magnesium hydroxide colloid, that is, a water-insoluble metal hydroxide colloid. The spread of the above colloid size was measured with a micro-trac particle size distribution measuring instrument(produced by NIKKISOU Co.) under conditions of measured range of 0.12 to 704 μm, measured time of 30 seconds and using ion exchanged water as a medium. D50, that is the particle size at 50 percent of the cumulative number distribution of particle size was 0.38 am. D90, that is the particle size at 90 percent of the cumulative number distribution of particle size was 0.82 μm.

To the above dispersion of magnesium hydroxide colloid, the above core monomer mixture was added, and was maintained at 20 to 30 degrees centigrade while stirring for 2 to 3 minutes with a low speed agitator. At the time primary droplets having a volume average droplet size of about 200 μm were formed, 4 parts of t-butyl peroxy-2-ethylhexanoate were added. The resulting mixture was further stirred at 12,000 rpm by means of TK homo-mixer until secondary droplets of core monomer mixture having a volume average droplet size of about 5 μm were formed. The obtained aqueous dispersion of core monomer mixture was charged in a polymerization reactor with agitator, polymerization reaction was begun at a reactor temperature of 90 degrees centigrade. When the polymerization conversion was 85%, 110 parts of the above shell monomer dispersion and 1 part of potassium persulfate were added while maintaining the reactor at the same temperature. After 5 hours, the polymerization reaction was stopped to obtain an aqueous dispersion of toner particles having a core-shell structure. The pH of the aqueous dispersion of toner particles was about 11.

The aqueous dispersion of toner particles having core-shell structure was brought to a pH of about 5.5 by sulfuric acid, was washed at 25 degrees centigrade for 10 minutes, was continuously dehydrated with a belt filter('EAGLE FILTER' as trade name, produced by SUMITOMO JUKIKAI KOUGYO Co.) and then ion exchanged water was sprinkled over the dehydrated toner particles to rinse.

The rinsed toner particles were reslurried by adding ion exchanged water. The reslurried toner particles dispersion was centrifugal dehydrated with a siphon peeler centrifuge ('HZ40Si', produced by MITSUBISHI KAKOUKI Co.) under conditions of a centrifugal acceleration of 1200 G, thickness of filter cake layer of 10 mm, area of filter cake layer of 0.25 $m^2$ in which the filter cake layer contains larger size polymer particles for filtration having a volume average particle size of 7.8 μm and obtained by suspension polymerization of a composition which comprises 85 parts of styrene, 15 parts of n-butyl acrylate, 0.3 part of divinylbenzene, 2 parts of surface lubricant, 7 parts of carbon black ('Monark 120' trade name; produced by Cabot Co.) and 1 part of charge control agent ('Aizen Spilon Black TRH' trade name, produced by HODOGAYA Chemical Co.), ion exchanged water supply for rinse of 40 parts a hour, and the polymer particles dispersion supply of 120 parts a hour to obtain the toner particles having the percentage of moisture content of 15%. The filter cake layer had not been clogged for at least 5 hours of nonstop filtration. Finally, the above obtained toner particles having moisture was dried for 2 days in a dryer of 45° C. to obtain toner particles for developer.

To 100 parts of the toner particles for developer, 1 part of hydrophobic colloidal silica ('AEROSIL R-170' Trade name, average particle size is 15 nm, produced by Japan Aerosil Co.) and 1 part of hydrophobic colloidal silica ('AEROSIL RX-50' Trade name, average particle size is 40 nm, produced by Japan Aerosil Co.) were added and were mixed with a Henschel mixer to make an electrophotographic one component nonmagnetic developer.

The resistivity of the developer obtained by the above process was 11.5 (log Ωcm). The volume average particle size(dv) of the developer is 6.9 μm, the proportion(dv/dp) of the volume average particle size (dv) and the number average particle size(dp) is 1.27, and the ratio of major axis and minor axis(rl/rs) was 1.1.

In the image evaluation, printing density was high, fog or patches were not found, and an image having an excellent resolution and a good color tone could be obtained (Rating A). The other evaluations are shown in Table 1.

EXAMPLE 2

A developer was made by the same manner as described in Example 1 except that the aqueous dispersion was brought to a pH of about 3 by sulfuric acid. The filter cake layer had not been clogged for at least 5 hours of nonstop filtration. The obtained toner particles by centrifugal filtration had the percentage of moisture content of 14%. Also the results are shown in Table 1.

EXAMPLE 3

A developer was made by the same manner as described in Example 1 except that the larger size polymer particles used for the filter cake layer in Example 1 were replaced by polymer particles having volume average particle size of 9.5 μm and obtained by suspension polymerization of a composition which comprises 85 parts of styrene, 15 parts of n-butyl acrylate, 0.3 part of divinylbenzene, 2 parts of surface lubricant, 7 parts of carbon black ('Monark 120' trade name; produced by Cabot Co.) and 1 part of charge control agent ('Aizen Spilon Black TRH' trade name, produced by HODOGAYA Chemical Co.). The filter cake layer had not been clogged for at least 5 hours of nonstop filtration. The obtained toner particles by centrifugal filtration had the percentage of moisture content of 12%. Also the results are shown in Table 1.

EXAMPLE 4

A developer was made by the same manner as described in Example 1 except that the polymer particles used for the filter cake layer in Example 1 were replaced by polymer particles having volume average particle size of 7.3 μm which is 0.5 μm smaller than the toner particles. The obtained toner particles by centrifugal filtration had the percentage of moisture content of 18%. After 15 hour continuous filtration, the filter cake layer used in a filtration step was not closely packed and the available channels in the filter cake layer were kept for the filtration. Also the results are shown in Table 1.

COMPARATIVE EXAMPLE 1

A developer was made by the same manner as described in Example 2 except that the larger size polymer particles used for the filter cake layer in Example 2 were replaced by polymer particles having volume average particle size of 6.1 μm and obtained by suspension polymerization of a composition which comprises 85 parts of styrene, 15 parts of n-butyl acrylate, 0.3 part of divinylbenzene, 2 parts of surface lubricant, 7 parts of carbon black ('Monark 120' trade name; produced by Cabot Co.) and 1 part of charge control agent ('Aizen Spilon Black TRH' trade name, produced by HODOGAYA Chemical Co.). Since the filter cake layer was clogged shortly after beginning of nonstop filtration, an operativity was low. The obtained toner particles by centrifugal filtration had the percentage of moisture content of 28%. Also the results are shown in Table 2.

COMPARATIVE EXAMPLE 2

A developer was made by the same manner as described in Example 2 except that after continuous dehydration with a belt filter in Example 2, the rinsed toner particles were not reslurried or centrifugal filtered. The results are shown in Table 2.

COMPARATIVE EXAMPLE 3

A developer was made by the same manner as described in Example 1 except that the aqueous dispersion was brought to a pH of about 6.8 by sulfuric acid, and the larger size polymer particles used for the filter cake layer were replaced by polymer particles having volume average particle size of 6.3 μm and obtained by suspension polymerization of a composition which comprises 85 parts of styrene, 15 parts of n-butyl acrylate, 0.3 part of divinylbenzene, 2 parts of surface lubricant, 7 parts of carbon black ('Monark 120' trade name; produced by Cabot Co.) and 1 part of charge control agent ('Aizen Spilon Black TRH' trade name, produced by HODOGAYA Chemical Co.). Since the filter cake layer was clogged shortly after beginning of nonstop filtration, an operativity was low. The obtained toner particles by centrifugal filtration had the percentage of moisture content of 42%. Also the results are shown in Table 2.

The electrophotographic developer of this invention has good shelf stability and fluidity, and a lesser reduction in image quality under various conditions. This developer can be advantageously used for an electrophotographic one component nonmagnetic developing system printer or copier.

TABLE 1

| | Example | | | |
|---|---|---|---|---|
| | 1 | 2 | 3 | 4 |
| pH of dispersion at filtration | 5.5 | 3.0 | 5.3 | 6.0 |
| larger size polymer particles | | | | |
| particle size [μm] | 7.8 | 7.8 | 9.5 | 7.3 |
| percentage of not more than 5 μm [number %] | 39 | 27 | 21 | 18 |
| toner particles for developer | | | | |
| particle size [μm] | 6.9 | 7.0 | 7.0 | 7.8 |
| moisture content after filtration [%] | 15 | 14 | 12 | 18 |
| operativity | good | good | good | good |
| developer | | | | |
| pH | 4.75 | 5.10 | 6.30 | 6.20 |
| σ2 [μS/cm] | 14.9 | 14.4 | 13.3 | 13.5 |
| σ2-σ1 [μS/cm] | 4.5 | 4.7 | 3.5 | 3.8 |
| D2 [μS/cm] | 5.5 | 5.3 | 4.8 | 5.2 |
| D2-σ1 [μS/cm] | 3.5 | 3.2 | 2.8 | 2.9 |
| Fixing temperature [° C.] | 120 | 125 | 120 | 120 |
| Fluidity [%] | 87 | 90 | 92 | 89 |
| Shelf stability [%] | 3 | 2 | 3 | 3 |
| amount of electron charge | | | | |
| H/H [μc/g] | −28 | −30 | −27 | −27 |
| L/L [μc/g] | −31 | −32 | −30 | −32 |
| Image quality | | | | |
| H/H | A | A | A | A |
| L/L | A | A | A | A |

TABLE 2

| | Comparative Example | | |
|---|---|---|---|
| | 1 | 2 | 3 |
| pH of dispersion at filtration | 3.3 | 3.1 | 6.8 |
| larger size polymer particles | | | |
| particle size [μm] | 6.1 | — | 6.3 |
| percentage of not more than 5 μm [number %] | 60 | — | 44 |
| toner particles for developer | | | |
| particle size [μm] | 7.2 | 7.1 | 7.0 |
| moisture content after filtration [%] | 28 | 35 | 42 |
| operativity | No good | No good | No good |
| developer | | | |
| pH | 3.87 | 3.55 | 7.26 |

TABLE 2-continued

| | Comparative Example | | |
|---|---|---|---|
| | 1 | 2 | 3 |
| σ2 [μS/cm] | 28.4 | 36.4 | 42.8 |
| σ2-σ1 [μS/cm] | 18.8 | 26.2 | 32.4 |
| D2 [μS/cm] | 11.1 | 14.3 | 17.5 |
| D2-σ1 [μS/cm] | 9.1 | 12.4 | 15.0 |
| Fixing temperature [° C.] | 135 | 135 | 130 |
| Fluidity [%] | 68 | 62 | 70 |
| Shelf stability [%] | 12 | 18 | 11 |
| amount of electron charge | | | |
| H/H [μc/g] | −26 | −27 | −22 |
| L/L [μc/g] | −38 | −40 | −33 |
| Image quality | | | |
| H/H | C | C | C |
| L/L | B | B | B |

We claim:

1. A method of producing an electrophotographic developer comprising the steps of:

polymerizing polymerizable monomer to obtain an electrophotographic toner particles dispersion, filtering the electrophotographic toner particles dispersion through a filter cake layer containing polymer particles in order to clean the electrophotographic toner particles, drying the electrophotographic toner particles, and adhering outer-additives on the electrophotographic toner particles.

2. The method according to claim 1, further comprising a step of regulating pH, before the filtering step, so that the electrophotographic toner particles dispersion has a pH of not more than 6.5.

3. The method according to claim 1, wherein the electrophotographic toner particles dispersion obtained by the polymerizing step has a pH of 8 to 12.

4. The method according to claim 1, wherein the electrophotographic toner particles have an average particle size of 1 to 20 μm.

5. The method according to claim 1, wherein the electrophotographic toner particles have an average particle size of 1.5 to 15 μm.

6. The method according to claim 1, wherein a volume average particle size of the polymer particles in the filter cake layer is larger than a volume average particle size of the electrophotographic toner particles by 10 μm or less, or is smaller than the volume average particle size of the electrophotographic toner particles by 1 μm or less.

7. The method according to claim 1, wherein a volume average particle size of the polymer particles in the filter cake layer is larger than a volume average particle size of the electrophotographic toner particles by 5 μm or less, or is smaller than the volume average particle size of the electrophotographic toner particles by 0.5 μm or less.

8. The method according to claim 1, wherein the polymer particles in the filter cake layer are formed of copolymer comprising styrene, methacrylate or acrylate.

9. The method according to claim 1, wherein the polymer particles in the filter cake layer contain colorant, electric charge controlling agent and surface lubricant.

10. The method according to claim 1, wherein the polymer particles in the filter cake layer have a melt index of not more than 60 at a temperature of 150° C. and a load of 10 kgf.

11. The method according to claim 1, wherein the polymerizable monomer comprises styrene, acrylate or methacrylate.

12. The method according to claim 11, wherein the polymerizable monomer further comprises crosslinkable monomer.

13. The method according to any one of claims 11, wherein the polymerizable monomer further comprises macro monomer.

14. The method according to claim 12, wherein the polymerizable monomer further comprises macro monomer.

15. The method according to claim 1, wherein the outer-additive comprises a small size particle having average particle size of 5 nm to 20 nm and a large size particle having average particle size of more than 20 nm and not more than 2 $\mu$m.

16. The method according to claim 1, wherein the outer-additive comprises a small size particle having average particle size of 7 nm and a large size particle having average particle size of 30 nm to 1 $\mu$m.

17. The method according to claim 1, wherein the toner particles comprise colorant electric charge controlling agent and surface lubricant.

* * * * *